US008754582B2

(12) United States Patent
Klier et al.

(10) Patent No.: US 8,754,582 B2
(45) Date of Patent: Jun. 17, 2014

(54) DETECTOR CIRCUIT AND METHOD FOR ACTUATING A FLUORESCENT LAMP

(75) Inventors: Juergen Klier, Traunreut (DE); Richard Pfaller, Traunwalchen (DE)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 171 days.

(21) Appl. No.: 13/144,505

(22) PCT Filed: Nov. 13, 2009

(86) PCT No.: PCT/EP2009/065091

§ 371 (c)(1),
(2), (4) Date: Jul. 14, 2011

(87) PCT Pub. No.: WO2010/081571

PCT Pub. Date: Jul. 22, 2010

(65) Prior Publication Data

US 2011/0273096 A1 Nov. 10, 2011

(30) Foreign Application Priority Data

Jan. 16, 2009 (DE) ..... 10 2009 004 852

(51) Int. Cl.
*H05B 41/295* (2006.01)
*H05B 41/28* (2006.01)

(52) U.S. Cl.
CPC ..... *H05B 41/295* (2013.01); *H05B 41/28* (2013.01)
USPC ..... 315/199; 315/200 R; 315/209 R; 315/195; 315/307

(58) Field of Classification Search
CPC ..... H05B 41/28; H05B 41/295
USPC ..... 315/121, 210, 200 R, 209 R, 195, 199, 315/307
See application file for complete search history.

(56) References Cited

U.S. PATENT DOCUMENTS

| | | | | |
|---|---|---|---|---|
| 6,232,727 | B1 | 5/2001 | Chee et al. | |
| 6,288,500 | B1 * | 9/2001 | Klier | 315/209 R |
| 6,476,567 | B1 * | 11/2002 | Pienisaari | 315/307 |
| 8,212,497 | B2 * | 7/2012 | Yadlapalli et al. | 315/294 |
| 2003/0122506 | A1 * | 7/2003 | Kamata et al. | 315/291 |
| 2003/0168995 | A1 | 9/2003 | Grabner et al. | |
| 2003/0168997 | A1 * | 9/2003 | Nishimoto et al. | 315/291 |
| 2004/0263089 | A1 | 12/2004 | Contenti et al. | |
| 2005/0168174 | A1 | 8/2005 | Edamura | |

FOREIGN PATENT DOCUMENTS

| | | | |
|---|---|---|---|
| DE | 19524185 | A1 | 10/1996 |
| DE | 19837728 | A1 | 2/2002 |
| EP | 1343359 | A2 | 9/2003 |
| WO | 9743878 | A1 | 11/1997 |
| WO | 2005101921 | A2 | 10/2005 |
| WO | 2006117809 | A1 | 11/2006 |
| WO | WO 2006117809 | A1 * | 11/2006 |
| WO | 2008119376 | A1 | 10/2008 |

OTHER PUBLICATIONS

English Abstract for DE19524185 A1. Oct. 24, 1996.

* cited by examiner

*Primary Examiner* — Jason M Crawford

(57) ABSTRACT

A detector circuit for actuating at least one fluorescent lamp may be configured such that the actuation of at least one fluorescent lamp occurs as a function of a first signal at a first input and as a function of a second signal at a second input if the first signal and the second signal are each greater than a first prescribed voltage and less than a second prescribed voltage during a start-up phase.

12 Claims, 5 Drawing Sheets

DETECTOR CIRCUIT AND METHOD FOR ACTUATING A FLUORESCENT LAMP

RELATED APPLICATIONS

The present application is a national stage entry according to 35 U.S.C. §371 of PCT application No.: PCT/EP2009/065091 filed on Nov. 13, 2009, which claims priority from German application No.: 10 2009 004 852.9 filed on Jan. 16, 2009.

TECHNICAL FIELD

Various embodiments relate to a detector circuit, to an electronic ballast and to a method for actuating at least one fluorescent lamp.

BACKGROUND

One possible cause of failure of fluorescent lamps is a reduced emission capacity of the electrodes (what is known as the "end of life effect"). This effect occurs at the end of the service life of a fluorescent lamp at one of the two electrodes. This leads to the discharge current flowing more lightly through the lamp in one direction than in the opposing direction. In this case the fluorescent lamp functions as a rectifier. The electrode which is not capable of emission is heated so much in the process that high temperatures can occur at the lamp surface. In an extreme case the glass tube can melt in the case of fluorescent lamps with a small diameter.

An electronic ballast (EB) for actuation of the fluorescent lamp must detect such a fault in good time and either limit output current and output voltage respectively to an uncritical value or turn off the fluorescent lamp.

Above and beyond actual lamp operation the EB must fulfill various control and monitoring functions. Separate circuit components are required for such control and monitoring functions—in particular according to the circuit of the EB.

SUMMARY

Various embodiments may avoid the above-mentioned drawbacks and may e.g. create a method for an efficient and flexible electronic ballast and a versatile detector circuit for actuating a lamp which, by way of example, performs control and/or monitoring functions according to the circuit.

Various embodiments provide a detector circuit for actuating a fluorescent lamp, wherein actuation of the at least one fluorescent lamp occurs as a function of a first signal at a first input and as a function of a second signal at a second input, in particular by means of a half-bridge inverter, if the first signal and the second signal are each greater than a first prescribed voltage and less than a second prescribed voltage during a start-up phase.

The start-up phase is in particular a period before actuation of the at least one fluorescent lamp. Such an actuation can, for example, occur by means of a half-bridge circuit (or by means of a half-bridge inverter), by means of a full-bridge circuit or by means of a push-pull circuit.

It should be noted in this connection that the first prescribed voltage is preferably less than the second prescribed voltage. In other words, actuation of the at least one fluorescent lamp occurs—directly or indirectly (for example via the at least one half-bridge inverter)—if the first and second signals are each in an interval between the first prescribed voltage and the second prescribed voltage.

At least one filament in the at least one fluorescent lamp can therefore advantageously be recognized, wherein the detector circuit can be used in different EB topologies ("lamp-to-ground" or "capacitor-to-ground" circuits) and in particular in combination with one fluorescent lamp or with two fluorescent lamps.

It should also be noted that the upper threshold in accordance with a high voltage (for example greater than the second prescribed voltage) at least one of the two inputs can be synonymous with a high current flow in the detector circuit. By way of example, the detector circuit may include a power source which loads a supply voltage of the detector voltage in accordance with a high voltage of this kind in such a way that the at least one fluorescent lamp can no longer be actuated. The high voltage at least one of the two inputs therefore alternatively or additionally corresponds to a high current which is converted by the power source from the supply voltage and prevents actuation of the at least one fluorescent lamp.

A further advantage of the present approach lies in that the detector circuit can be flexibly used and therefore a large number of circuit components otherwise necessary for control and monitoring functions can be omitted.

Therefore one development is that the second prescribed voltage is prescribed by a power source.

In particular one development is that at least one of the inputs is connected to the power source, wherein the power source loads a supply voltage as a function of at least one voltage at least one of the inputs.

By way of example, the power source is designed as a controllable power source.

One development is that the detector circuit for actuation of the at least one fluorescent lamp can be used before starting an electronic ballast.

Filament detection is preferably used before an electronic ballast starts or before an ignition of a fluorescent lamp.

A further development is that no actuation of the at least one fluorescent lamp occurs, in particular by means of the at least one half-bridge inverter, if the first signal or the second signal is greater than the second prescribed voltage or if the first signal or the second signal is less than the first prescribed voltage during the start-up phase.

In this case the filaments have (still) not been correctly detected, the at least one fluorescent lamp is still not actuated or the EB is waiting in particular until the filaments are correctly contacted.

This has the advantage in particular that ignition of the fluorescent lamp does not occur if it is inserted in a socket at only one side and therefore, for example when changing the fluorescent lamp, the user cannot receive an electrical shock.

One development in particular is that in the case of a circuit with one fluorescent lamp, the first signal across a voltage divider matches a voltage at the fluorescent lamp, and the second signal across a voltage divider matches a comparison voltage, in the case of a circuit with two fluorescent lamps, the first signal across a voltage divider matches a voltage at the first fluorescent lamp, and the second signal across a voltage divider matches a voltage at a second fluorescent lamp.

The detector circuit can therefore advantageously be used in a circuit with one fluorescent lamp or in a circuit with two fluorescent lamps.

One development is also that the at least one fluorescent lamp can be operated in a capacitor-to-ground or in a lamp-to-ground topology.

It is therefore possible to use the detector circuit in different topologies, i.e. circuits of the at least one fluorescent lamp. The detector circuit correctly derives the required behavior or the required control and monitoring functions, in both forms of the circuit.

One development is, moreover, that during a start-up phase it can be determined whether one fluorescent lamp or two fluorescent lamps is/are connected in that the detector circuit compares the voltages at the inputs.

It should be noted in this connection that the start-up phase includes a period for filament monitoring and/or a period for pre-heating the at least one fluorescent lamp. During this start-up phase preparatory measurements and monitorings can be carried out before the at least one fluorescent lamp is ignited.

One development is also that the detector circuit is adapted in such a way that it can be determined that two fluorescent lamps are connected if the two voltages at the inputs compared during the start-up phase are approximately equal, wherein otherwise only one fluorescent lamp is connected.

The detector circuit can therefore automatically detect whether it is used in one case or the other.

Use of just one fluorescent lamp may be inferred in particular for the case where the voltages at the two inputs differ by approximately a factor of two. Accordingly both comparisons (voltages at the inputs approximately equal and voltages at the inputs significantly (approximately factor 2) different) or only one of the two measurements can be used to determine whether one fluorescent lamp is connected or whether two fluorescent lamps are connected.

Within the framework of an additional development an inactive fluorescent lamp can be detected if after the start-up phase the first signal and/or the second signal is/are in a detection interval.

The fluorescent lamp is inactive in particular if it has not yet been ignited or it is extinguished.

By way of example, the detection interval matches a voltage interval in a range from approx. 2V to approx. 3V.

Another development consists in that actuation after the start-up phase for the case of one connected fluorescent lamp can be performed as a function of the first signal at the first input and as a function of the second signal at the second input according to at least one of the following criteria:

if the first signal or the second signal is in a first voltage interval respectively, an output voltage is reduced or a frequency of actuation is increased, if the first signal or the second signal is in a second voltage interval respectively and the other signal respectively is in a second or third voltage interval, the fluorescent lamp is actuated with an ignition voltage, if the first signal and the second signal are in the third voltage interval, the fluorescent lamp is actuated and an output voltage at the fluorescent lamp is monitored in particular, if the first signal or the second signal is in a fourth voltage interval respectively, the output voltage is reduced or the frequency of actuation is increased.

It should be noted that the criteria stated above can be used individually or in combination with each other.

One development is that actuation after the start-up phase for the case of two connected fluorescent lamps can be performed as a function of the first signal at the first input and as a function of the second signal at the second input according to at least one of the following criteria:

if the first signal or the second signal is in a first voltage interval respectively, an output voltage is reduced or a frequency of actuation is increased, if the first signal or the second signal is in a second voltage interval, the fluorescent lamp is actuated with an ignition voltage, if only the first signal or only the second signal is in the second voltage interval and the other signal respectively is in a third voltage interval, the fluorescent lamp is actuated with a reduced ignition voltage, if the first signal and the second signal are in the third voltage interval, the fluorescent lamp is actuated and an output voltage at the fluorescent lamp is monitored in particular, if the first signal or the second signal respectively is in a fourth voltage interval, the output voltage is reduced or the frequency of actuation is increased.

It should be noted that the wording "only the first signal or only the second signal" corresponds to an EXOR operation of the first and second signal.

The above-mentioned reduction in output voltage can also include the possibility that actuation of the at least one fluorescent lamp does not happen or the detector circuit and/or the electronic ballast is/are turned off.

It should be noted that the criteria mentioned above can be used individually or in combination with each other.

In particular the voltage intervals are arranged so as to be joined together. By way of example, the following voltage intervals could be used:

first voltage interval: the voltage is greater than 3V, second voltage interval: the voltage is in a range from 2V to 3V (inclusive in each case), third voltage interval: the voltage is in a range from 0.5V (inclusive) to 2V, fourth voltage interval: the voltage is less than 0.5V.

An alternative embodiment consists in that comparators are provided for determining the voltage intervals.

A next embodiment is that the signals of the inputs can be determined by means of a microcontroller.

The comparators can accordingly be used with associated switching logic for detecting the thresholds. Alternatively or additionally at least one microcontroller, optionally in conjunction with at least one analog-to-digital converter (A/D converter) can be used to detect the signals present at the inputs and to evaluate them appropriately.

One embodiment is also that the at least one fluorescent lamp can be actuated by means of at least one half-bridge across a voltage-controlled oscillator.

By way of example, the at least one half-bridge or the voltage-controlled oscillator can be part of the detector circuit or part of the electronic ballast for operating the at least one fluorescent lamp. In particular, the detector circuit can also be part of the electronic ballast or be linked thereto.

One development consists in that at least one input is connected to a controllable power source, with the controllable power source loading a supply voltage as a function of at least one voltage at least one input.

In this respect the power source can load the supply voltage, as a function of a voltage applied at least one of the inputs, with an accordingly high current so, for example, actuation of the at least one fluorescent lamp does not happen (or can no longer occur) owing to the high voltage at the affected input.

Another embodiment is that the detector circuit is constructed at least partially in the form of an integrated circuit.

Various embodiments provide an electronic ballast for actuation of at least one fluorescent lamp including a detector circuit as described herein.

The EB in particular provides functions for dimming the at least one fluorescent lamp and for the end-of-life detection. With the aid of the detector circuit a fault during operation of a fluorescent lamp can be detected in good time and there is no further actuation of this lamp (i.e. the fluorescent lamps are switched to inactive).

One embodiment is also that the circuit arrangement can be used for the end-of-life detection and for turning off the fluorescent lamp.

Various embodiments provide a circuit arrangement for actuation of at least one fluorescent lamp, including:

- a half-bridge inverter with at least one load circuit connected downstream,
- at least one coupling capacitor which is connected to the load circuit and to the half-bridge inverter,
- with the load circuit including terminals for the at least one fluorescent lamp,
- a detector circuit as claimed in any one of claims 1 to 15 for actuating the half-bridge inverter.

Various embodiments provide a method for operating the detector circuit according to the statements made herein.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
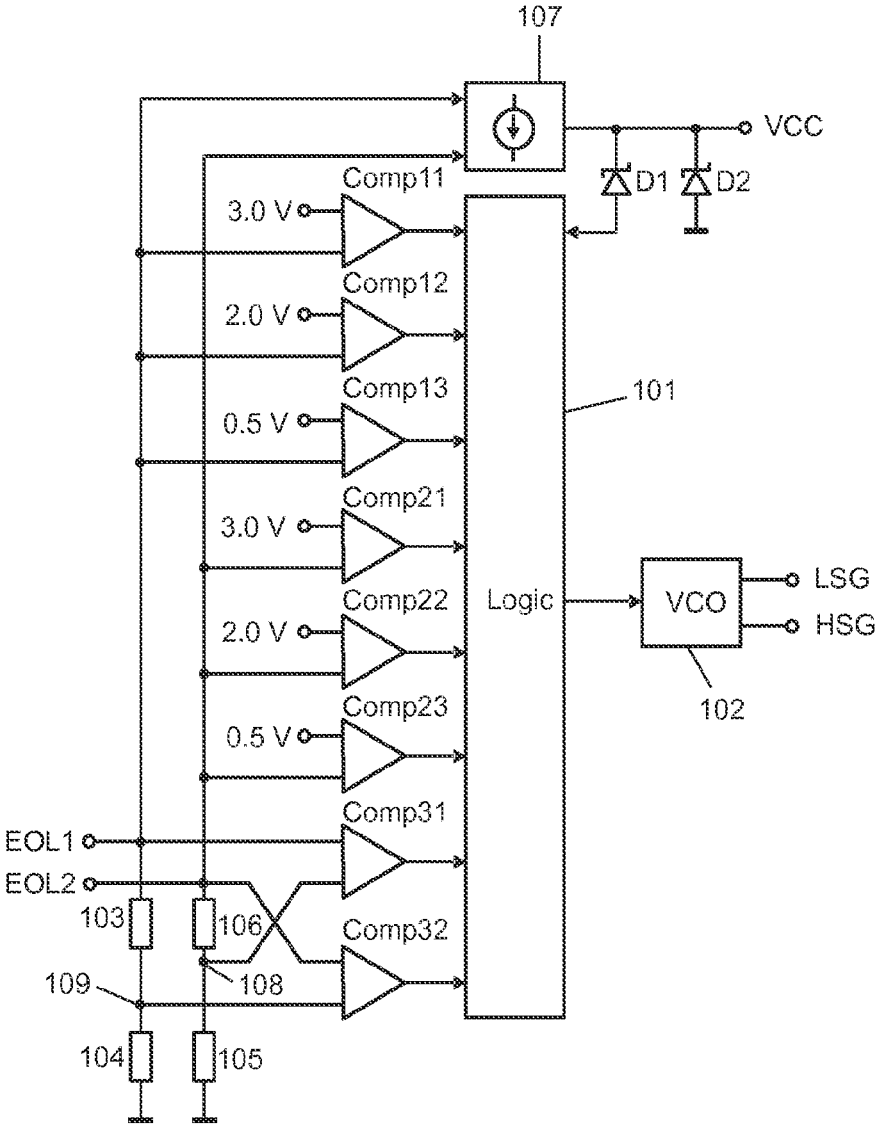
FIG. 1 shows, by way of example, a construction of a control circuit for actuation of at least one fluorescent lamp.

FIG. 1 shows, by way of example, a construction of a control circuit for actuation of at least one fluorescent lamp.

FIG. 1 includes a plurality of comparators Comp11, Comp12, Comp13, Comp21, Comp22, Comp23, Comp31 and Comp32, whose outputs are connected to a logic unit 101. The logic unit 101 actuates a voltage-controlled oscillator VCO 102 at whose output two actuation signals LSG, HSG are provided, for example for actuation of electronic switches of a half-bridge circuit or a half-bridge inverter.

The control circuit can be part of an end-of-life circuit, in particular an end-of-life detector circuit for operation and/or monitoring of at least one fluorescent lamp.

The control circuit can be part of an integrated circuit which can be used to control an electronic ballast (EB) or at least one half-bridge.

The control circuit according to FIG. 1 includes two inputs EOL1, EOL2, and an input for a supply voltage VCC. The two inputs EOL1 and EOL2 are capable of detecting a voltage at a fluorescent lamp or in connection with a fluorescent lamp. The voltage detected per input EOL1 and/or EOL2 respectively can be suitably evaluated by means of the control circuit.

By way of example, the control circuit according to FIG. 1 is constructed as follows for this purpose: the input EOL1 is connected to an input of the comparator Comp31, the other input of the comparator Comp31 is connected to a node 108. The node 108 is connected by a resistor 106 to the input EOL2. The node 108 is also connected by a resistor 105 to ground. The input EOL2 is also connected to an input of the comparator Comp32, whose other input is connected to a node 109. The node 109 is connected by a resistor 104 to ground and by a resistor to the input EOL1.

The input EOL1 is connected to one input each of the comparators Comp11, Comp12 and Comp13. The other input of the comparator Comp11 is at a potential of 3V, the other input of the comparator Comp12 is at a potential of 2V and the other input of the comparator Comp13 is at a potential of 0.5V.

The input EOL2 is connected to one input each of the comparators Comp21, Comp22 and Comp23. The other input of the comparator Comp21 is at a potential of 3V, the other input of the comparator Comp22 is at a potential of 2V and the other input of the comparator Comp23 is at a potential of 0.5V.

Using the comparators it may be determined in which of the at least four voltage ranges respectively the input voltages at the inputs EOL1 and EOL2 are.

The input EOL1 is connected to an input of a power source 107 and the input EOL2 is connected to another input of the power source 107. The power source is also connected to the supply voltage VCC. The supply voltage VCC is connected by a Z diode D1 to the logic unit 101 and a Z diode D2 is arranged between the supply voltage VCC and ground.

The two inputs EOL1 and EOL2 or just one of the two inputs can therefore be connected to the controllable power source 107 which loads the supply VCC as a function of the voltages at the inputs EOL1 and EOL2. The logic unit 101 is released for actuation of the VCO 102 by the Z diode D1 if the supply voltage VCC exceeds a prescribed value. The Z diode D2 prevents a further increase in this supply voltage VCC.

Exemplary circuit arrangements of electronic ballasts (EB) with one or two fluorescent lamp(s) in different circuits will be described below. Each of the circuit arrangements includes the control circuit shown in FIG. 1 and described above in the form of what are known as "control circuits".

Basically for the circuit arrangements it is the case that the illustrated fluorescent lamps do not have to be part of the EBs and instead terminals (for example sockets) are preferably provided which can be contacted by the fluorescent lamps.

EB with One Fluorescent Lamp and "Capacitor-to-Ground" Circuit

Figure 2:
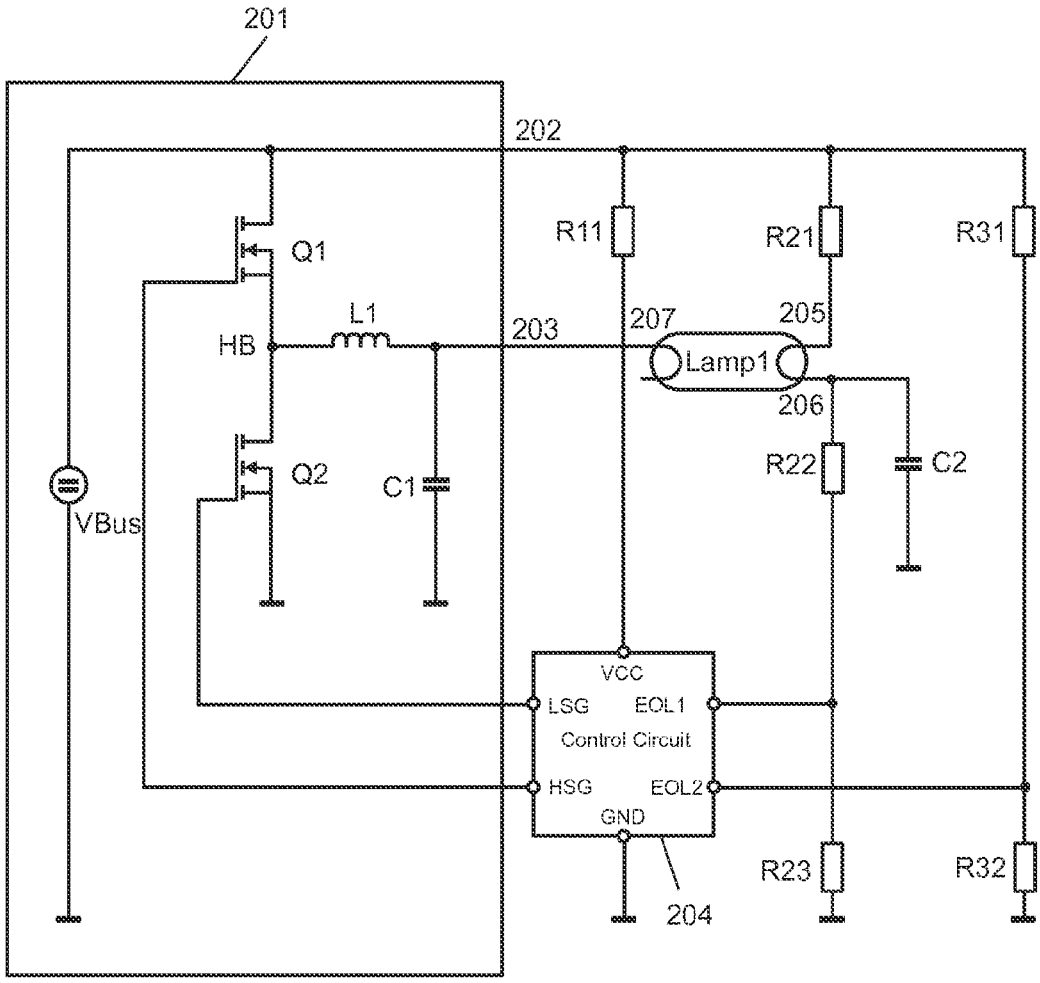
FIG. 2 shows an EB with one fluorescent lamp in a "capacitor-to-ground" topology.

FIG. 2 shows an EB with one fluorescent lamp in a "capacitor-to-ground" topology.

FIG. 2 shows a circuit block 201 which is also found in the following circuit arrangements and is also designated as a circuit block 201 there. The circuit block 201 will be described by way of example below.

A supply voltage or DC link voltage VBus is located between ground and a node 202. The node 202 is connected to the drain terminal of an n channel MOSFET Q1 whose source terminal is connected to a node HB and to the drain terminal of an n channel MOSFET Q2. The source terminal of the MOSFET Q2 is connected to ground. The gate terminal of the MOSFET Q1 is connected to the output LSG of the control circuit 204 and the gate terminal of the MOSFET Q2 is connected to the output HSG of the control circuit 204. The node HB is connected by a coil L1 to a node 203 and the node 203 is connected by a capacitor C1 to ground.

The circuit block 201 is therefore connected to the control circuit 204 on the one hand and is connected by the nodes 202 and 203 to the remaining circuit arrangement on the other hand.

According to FIG. 2 the node 202 is connected by a resistor R11 to the input for the supply voltage VCC of the control circuit 204. The node 202 is connected by a resistor R21 to a terminal 205 of the filament of the lamp Lamp1. The other terminal 206 of the filament is connected by a resistor R22 to the input EOL1 and the input EOL1 is connected by a resistor R23 to ground. The terminal 206 is also connected by a capacitor C2 to ground. The node 202 is connected by a resistor R31 to the input EOL2 and the input EOL2 is connected by a resistor R32 to ground. The node 203 is connected to a terminal 207 of a filament of the lamp Lamp1.

EB with Two Fluorescent Lamps and "Capacitor-to-Ground" Circuit

Figure 3:
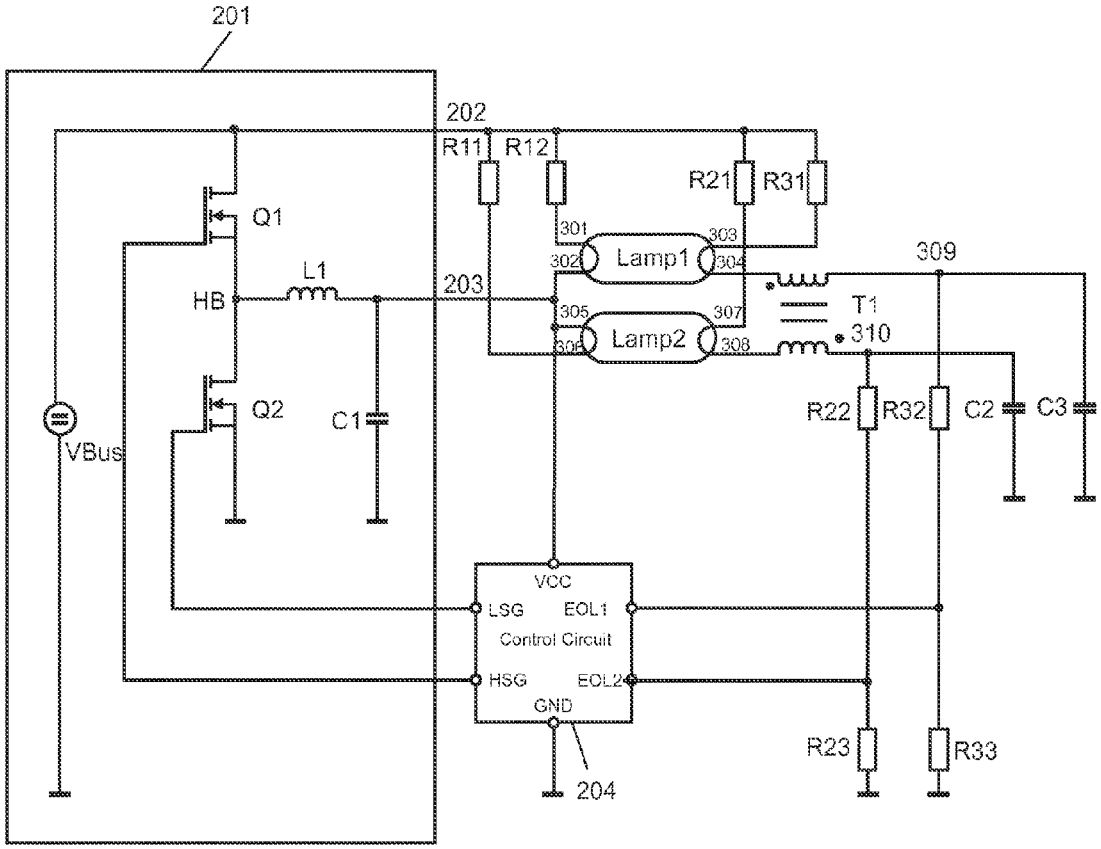
FIG. 3 shows an EB with two fluorescent lamps in a capacitor-to-ground" topology.

FIG. 3 shows an EB with two fluorescent lamps in a "capacitor-to-ground" topology.

According to the statements in relation to FIG. 2, the circuit block 201 is provided with the two nodes 202 and 203.

The EB is, by way of example, shown with two fluorescent lamps Lamp1 and Lamp2. This can be sockets for insertion of the fluorescent lamps in this connection. The fluorescent lamps include two filaments respectively each with two terminals. The fluorescent lamp Lamp1 therefore includes terminals 301 and 302 for connection to a first filament and terminals 303 and 304 for connection to a second filament. The fluorescent lamp Lamp2 accordingly includes terminals 305 and 306 for connection to a first filament and terminals 307 and 308 for connection to a second filament.

The node 202 is connected by a resistor R11 to the terminal 306, by a resistor R12 to the terminal 301, by a resistor R21 to the terminal 307 and by a resistor R31 to the terminal 303.

The node 203 is connected to the terminal 302, to the terminal 305 and by a resistor R13 to the input for the supply voltage VCC of the control circuit 204.

The terminal 304 is connected by the first coil of a transformer T1 to a node 309 and the terminal 308 is connected by the second coil of the transformer T1 to a node 310.

The node 309 is connected by a capacitor C3 to ground. The node 39 is also connected by a resistor R32 to the input EOL1, the input EOL1 being connected by a resistor R33 to ground.

The node 310 is connected by a capacitor C2 to ground. The node 310 is also connected by a resistor R22 to the input EOL2, the input EOL2 being connected by a resistor R23 to ground.

EB with One Fluorescent Lamp and "Lamp-to-Ground" Circuit

Figure 4:
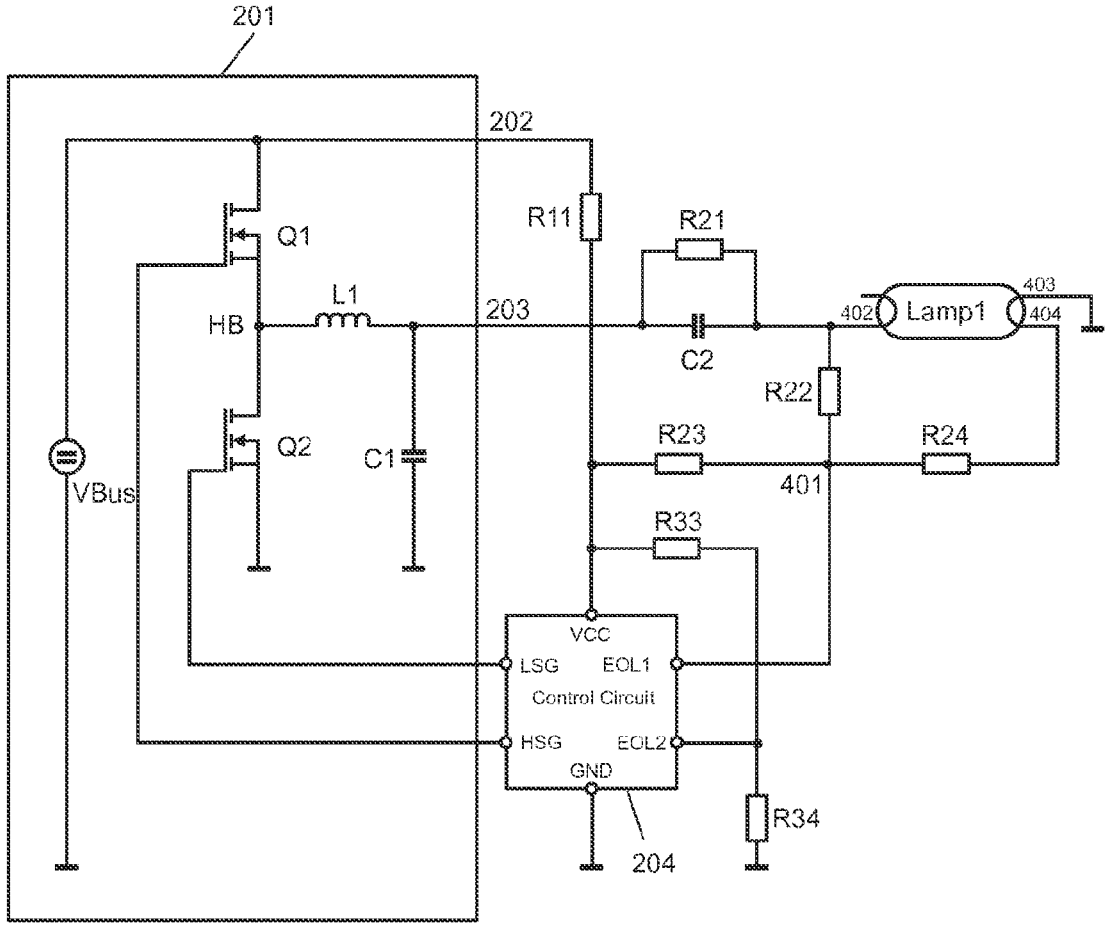
FIG. 4 shows an EB with one fluorescent lamp in a "lamp-to-ground" topology.

FIG. 4 shows an EB with one fluorescent lamp in a "lamp-to-ground" topology.

According to the statements relating to FIG. 2, the circuit block 201 is provided with the two nodes 202 and 203.

The node 202 is connected by a resistor R11 to the input for the supply voltage VCC of the control circuit 204.

The input of the supply voltage VCC is connected by a resistor R23 to a node 401 and by a resistor R33 to the input EOL2. The input EOL2 is connected by a resistor R34 to ground.

The node 203 is connected by a parallel circuit including a resistor R21 and a capacitor C2 to a terminal 402 for a first filament of a fluorescent lamp Lamp1 and by a resistor R22 to the node 401. The node 401 is connected to the input EOL1 and by a resistor R24 to a terminal 404 for a second filament of the fluorescent lamp Lamp2. A terminal 403 for the second filament of the fluorescent lamp is connected to ground.

EB with Two Fluorescent Lamps and "Lamp-to-Ground" Circuit

Figure 5:
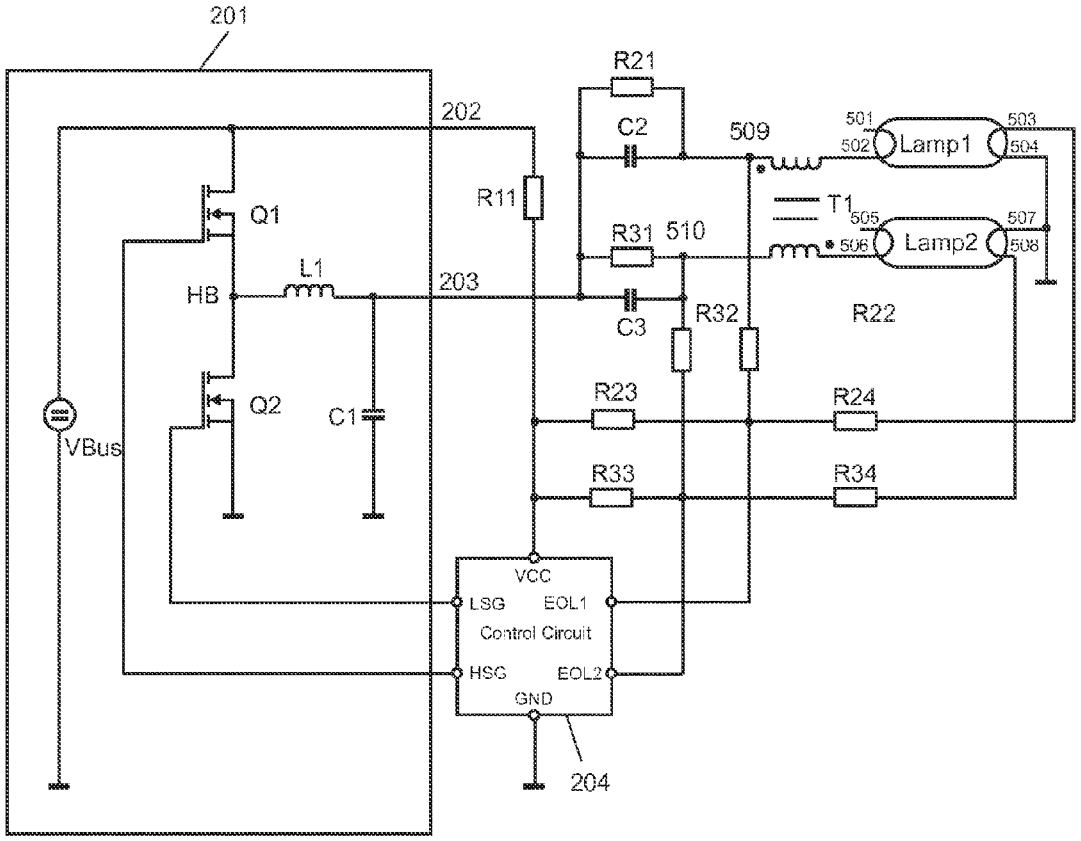
FIG. 5 shows an EB with two fluorescent lamps in a "lamp-to-ground" topology.

FIG. 5 shows an EB with two fluorescent lamps in a "lamp-to-ground" topology.

According to the statements relating to FIG. 2, the circuit block 201 is provided with the two nodes 202 and 203.

The EB is shown, by way of example, with two fluorescent lamps Lamp1 and Lamp2. This can be sockets for insertion of the fluorescent lamps. The fluorescent lamps include two filaments respectively, each with two terminals. The fluorescent lamp Lamp1 therefore includes terminals 501 and 502 for connection to a first filament and terminals 503 and 504 for connection to a second filament. The fluorescent lamp Lamp2 accordingly includes terminals 505 and 506 for connection to a first filament and terminals 507 and 508 for connection to a second filament.

The node 202 is connected by a resistor R11 to the input for the supply voltage VCC of the control circuit 204.

The input for the supply voltage VCC of the control circuit 204 is connected by a resistor R23 to the input EOL1 and by a resistor R33 to the input EOL2.

The node 203 is connected by a parallel circuit including a resistor R31 and capacitor C3 to a node 510 and by a parallel circuit including a resistor R21 and a capacitor C2 to a node 509.

The node 509 is connected by a resistor R22 to the input EOL1. The node 510 is connected by a resistor R32 to the input EOL2.

The node 509 is also connected by a first coil of a transformer T1 to the terminal 502. The node 510 is connected by a second coil of the transformer T1 to the terminal 506.

The input EOL1 is connected by a resistor R24 to the terminal 503 and the input EOL2 is connected by a resistor R34 to the terminal 508. The two terminals 504 and 507 are connected to ground.

Dimensioning of the Voltage Divider

The voltage dividers (R21, R22 and R31, R32 respectively) connected to a filament of the fluorescent lamp and to a coupling capacitor (C2, C3) are adjusted in such a way that the potential of these filaments during operation of the electronic ballast (VBus=400V, half-bridge transistors are actuated, potential at the node HB on average in respect of time is approximately 200V), provided the lamp is not alight, is significantly above the potential of the node HB, for example approximately 360V.

The potential of this filament continues to be divided down and supplied to an EOL input such that the voltage at this EOL input during operation of the EB is above 2V if the lamp is not alight (in this case the resistance of the lamp is infinite) and drops below 2V if the lamp has been ignited (in this case the resistance of the lamp is, for example, in a range from 100Ω to 100 kΩ).

In the case of the circuit arrangements with only one fluorescent lamp (FIG. 2, FIG. 4) the input EOL2 is connected to a voltage divider which divides a fixed voltage such that during operation with high lamp wattage (resistance of the lamp in a range from 100Ω to 1 kΩ by way of example) both inputs EOL1 and EOL2 have (approximately) the same input voltage.

In the circuit arrangement according to FIG. 2 the DC link voltage VBus is used for this purpose because the voltage at the input EOL1 also depends on the DC link voltage VBus. The supply voltage VCC is accordingly divided in the circuit arrangement according to FIG. 4 because here the voltage at EOL1 depends on this supply voltage VCC.

Filament Scanning

An EB which has switched off due to a lamp fault should automatically start again once the lamp has been changed.

For this purpose the electrical continuity of at least one of the two lamp filaments is controlled: with an interruption in the filament the switch-off function can be reset and with renewed continuity the EB can start again.

For safety reasons it is advantageous that the EB does not start if the lamp is only inserted into a socket at one side, where the ignition voltage is produced. If the terminals of the other lamp side are touched in such a case, the lamp would otherwise ignite and could cause an electrical shock.

The ignition voltage is produced at a socket which is connected to the resonance circuit (L1, C1). In the case of the EB with two fluorescent lamps (FIG. 3, FIG. 5), furthermore also at one socket which is connected to the transformer T1 (balancing transformer). The lamp filaments opposing these sockets in each case are preferably tested for electrical continuity.

Filament scanning preferably takes place before or during start-up of the EB. In this case the half-bridge transistors (Q1, Q2) have not yet been actuated, the DC link voltage (VBus) is, for example, in a range from 176V to 375V depending on line voltage. The lamps (Lamp1, Lamp2) are not yet alight (i.e. the resistance of the respective lamp is infinitely high).

When the filaments are used and in order the voltage at the inputs EOL1 and EOL2 is in a range from approximately 0.5V to approximately 3V.

If, on the other hand, a filament is missing the corresponding voltage at the inputs EOL1 and EOL2 in the circuits according to FIG. 2 and FIG. 3 is 0V respectively. In the circuits according to FIG. 4 and FIG. 5 the voltage at the inputs EOL1 and EOL2 is greater than 3V. The EB should not start up in either case (0V and greater than 3V). Only when the voltages at the inputs EOL1 and EOL2 are in a range from 0.5V to 3V does the EB start.

The following table summarizes filament scanning before start-up of the EB:

| Inputs | Condition | Cause | Reaction |
|---|---|---|---|
| EOL1 OR EOL2 | >3 V | Filament is missing | Wait |
| EOL1 AND EOL2 | 0.5 V-3 V | Filament OK | Start up |
| EOL1 OR EOL2 | <0.5 V | Filament is missing | Wait |

The first column of the above table illustrates which inputs EOL1 and/or EOL2 fulfill the conditions according to the second voltage. Depending on the state of the voltages at the inputs EOL1 and/or EOL2, the third column shows the cause and the fourth column includes the reaction of the detector circuit and/or the EB.

The circuit according to FIG. 3 includes a peculiarity: here all four filaments of the two lamps should expediently be monitored. For this purpose the supply current of the control circuit across the resistors R11 and R12 and across both filaments (terminals 301, 302 and 305, 306) is supplied to the resonance circuit lamp side. To keep the losses as small as possible the resistors R11 and R12 can be identical in construction and be twice as large as the resistor R13. If one of the two filaments is missing, the supply current sinks to ⅔ of its normal value. So this small change can be evaluated in a large line voltage range between 176V and 375V the supply current of the control circuit is made independent of the line voltage. This is achieved by the power source 107 which additionally loads the supply as a function of the line voltage (see FIG. 1 and associated description). The EB only starts if the remaining supply current of the control circuit does not fall below a certain minimum value (for example 150 μA).

The power source 107 is either controlled by the larger of the voltages at the inputs EOL1 and EOL2, which are each proportional to the DC link voltage VBus, or by the voltage at the input EOL1.

It is therefore advantageous that at least one missing filament of a fluorescent lamp can be detected in a lower voltage range and in an upper voltage range and therefore the control circuit can be universally used for different EB topologies ("lamp-to-ground" circuit, "capacitor-to-ground" circuit).

Ignition Control

If a lamp is not yet alight or if a lamp extinguishes for some reason during operation, it should be ignited.

The requisite ignition voltage, up to 750V depending on the lamp, should be provided by the EB for this. A lamp that is not alight is detected in that the voltage at the corresponding input EOL1 and/or EOL2 is more than 2V but less than 3V.

With a dimmable EB in particular, including two lamps, the ignition voltage of a lamp is almost doubled by the balancing transformer T1 if the other lamp is already alight. In this state the balancing transformer T1 is severely loaded owing to the high voltage and the high control range of the core. A reduction in the ignition voltage is therefore expedient for the duration of this state.

In this case the voltage at one of the inputs EOL1 or EOL2 is in a range from 0.5V to 2V, the voltage at the other input EOL2 or EOL1 is in a range between 2V and 3V (comparable with the case of the EBs with only one lamp, if this lamp is not alight).

To allow a correct reaction it should preferably be determined whether the control circuit is being operated with one lamp or two lamps. This can be determined in particular, provided a lamp is still not alight, i.e. during a pre-heating phase: in the case of the EB with one lamp the voltages at the inputs EOL1 and EOL2 differ by approximately a factor of 2, in the case of the EB with two lamps the voltages at the inputs EOL1 and EOL2 are approximately equal during the pre-heating phase. The voltages and their relation to each other can be determined by means of the control circuit, for example with the aid of the comparators Comp31 and Comp32 (see FIG. 1).

Monitoring the Output Voltage $U_{out}$

During normal operation of the EB (lamp alight) its output voltage should not lastingly exceed a certain value, for example 300V or 430V.

To ensure this the same controlled variables as for ignition control can be used, although the sensitivity can be increased accordingly.

The state "normal operation" can be detected with the aid of the voltages at the inputs EOL1 and EOL2; both are then in a range from 0.5V to 2V.

Hard rectifying operation constitutes a particular load for the EB, as is tested to EN 61000-3-2. Here a diode is connected in series with the lamp and the coupling capacitor (C2, C3) can therefore be strongly reloaded. The EB can be unloaded in this operating mode in that the operating frequency (wide) is increased above the resonance frequency of the output resonance circuit (L1, C1).

The following tables show one possibility for ignition control and for monitoring the output voltage of an EB following start-up thereof:

for the case of the EB with one lamp:

| Inputs | Condition | Cause | Reaction |
|---|---|---|---|
| 1 OR 2 | >3 V | Hard rectification | Increase frequency |
| 1 OR 2 | 2 V-3 V | Lamp is not alight | Full ignition voltage |
| 1 AND 2 | 0.5 V-2 V | Normal operation | Monitor $U_{out}$ |
| 1 OR 2 | <0.5 V | Hard rectification | Increase frequency |

and for the case of the EB with two lamps:

| Inputs | Condition | Cause | Reaction |
|---|---|---|---|
| 1 OR 2 | >3 V | Hard rectification | Increase frequency |
| 1 AND 2 | 2 V-3 V | Neither lamp is alight | Full ignition voltage |
| 1 EXOR 2 | 2 V-3 V | One lamp is not alight | Reduced ignition voltage |
| 1 AND 2 | 0.5 V-2 V | Normal operation | Monitor $U_{out}$ |
| 1 OR 2 | <0.5 V | Hard rectification | Increase frequency |

The same comparator thresholds can be used for the functions filament scanning and ignition control and for monitoring of the output voltage. The construction of the respective circuit is simplified as a result. It is also possible to provide separate comparator thresholds for each functionality (or parts thereof).

Instead of the comparators and the switching logic a microcontroller with A/D converter may also be provided which suitably evaluates the signals at the inputs EOL1 and EOL2 and actuates the at least one half-bridge or the at least one fluorescent lamp accordingly.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A detector circuit for actuating at least one fluorescent lamp, wherein the detector circuit is configured such that the actuation of at least one fluorescent lamp occurs as a function of a first signal at a first input and as a function of a second signal at a second input if the first signal and the second signal are each greater than a first prescribed voltage and less than a second prescribed voltage during a start-up phase, wherein the detector circuit is configured such that during a start-up phase it can be determined whether one fluorescent lamp or two fluorescent lamps is/are connected in that the detector circuit compares the voltages at the inputs, the detector circuit being configured in such a way that it can be determined that two fluorescent lamps are connected if the two voltages compared during the start-up phase are approximately equal, and wherein otherwise only one fluorescent lamp is connected.

2. The detector circuit as claimed in claim 1, wherein the second prescribed voltage is prescribed by a power source.

3. The detector circuit as claimed in claim 2, wherein at least one of the inputs is connected to the power source, with the power source loading a supply voltage as a function of at least one voltage at at least one of the inputs.

4. The detector circuit as claimed in claim 1, wherein the detector circuit is configured to actuate the at least one fluorescent lamp before starting an electronic ballast.

5. The detector circuit as claimed in claim 1, wherein the detector circuit is configured such that no actuation of the at least one fluorescent lamp occurs if the first signal or the second signal is greater than the second prescribed voltage or if the first signal or the second signal is less than the first prescribed voltage during the start-up phase.

6. The detector circuit as claimed in claim 1, wherein the detector circuit is configured such that, in the case of a circuit with one fluorescent lamp, the first signal across a voltage divider matches a voltage at the fluorescent lamp and the second signal across a voltage divider matches a comparison voltage, and in the case of a circuit with two fluorescent lamps, the first signal across a voltage divider matches a voltage at the first fluorescent lamp and the second signal across a voltage divider matches a voltage at a second fluorescent lamp.

7. The detector circuit as claimed in claim 1, wherein the detector circuit is configured such that the at least one fluorescent lamp can be operated in a capacitor-to-ground or in a lamp-to-ground topology.

8. The detector circuit as claimed in claim 1, wherein the detector circuit is configured such that an inactive fluorescent lamp can be detected if after the start-up phase the first signal and/or the second signal is/are in a detection interval.

9. The detector circuit as claimed in claim 1, wherein the detector circuit is configured such that the actuation after the start-up phase can be performed for the case of one connected fluorescent lamp as a function of the first signal at the first input and as a function of the second signal at the second input according to at least one of the following criteria:

if the first signal or the second signal is in a first voltage interval respectively, an output voltage is reduced or a frequency of actuation is increased, if the first signal or the second signal is in a second voltage interval respectively and the other signal respectively is in a second or third voltage interval, the fluorescent lamp is actuated with an ignition voltage, if the first signal and the second signal are in the third voltage interval, the fluorescent lamp is actuated and an output voltage at the fluorescent lamp is monitored, if the first signal or the second signal is in a fourth voltage interval respectively, the output voltage is reduced or the frequency of actuation is increased.

10. The detector circuit as claimed in claim 1, wherein the detector circuit is configured such that the actuation after the start-up phase can be performed for the case of two connected fluorescent lamps as a function of the first signal at the first input and as a function of the second signal at the second input according to at least one of the following criteria:

if the first signal or the second signal is in a first voltage interval respectively, an output voltage is reduced or a frequency of actuation is increased, if the first signal or the second signal is in a second voltage interval, the fluorescent lamp is actuated with an ignition voltage, if only the first signal or only the second signal is in the second voltage interval and the other signal respectively is in a third voltage interval, the fluorescent lamp is actuated with a reduced ignition voltage, if the first signal and the second signal are in the third voltage interval, the fluorescent lamp is actuated and an output voltage at the fluorescent lamp is monitored, if the first signal or the second signal respectively is in a fourth voltage interval, the output voltage is reduced or the frequency of actuation is increased.

11. The detector circuit as claimed in claim 1, wherein at least one input is connected to a controllable power source, with the controllable power source loading a supply voltage as a function of at least one voltage at at least one input.

12. The detector circuit as claimed in claim 1, wherein the detector circuit is configured such that the actuation of at least one fluorescent lamp occurs as a function of the first signal at a first input and as a function of the second signal at a second input by means of a half-bridge inverter, if the first signal and the second signal are each greater than a first prescribed voltage and less than a second prescribed voltage during a start-up phase.

* * * * *

UNITED STATES PATENT AND TRADEMARK OFFICE

CERTIFICATE OF CORRECTION

PATENT NO. : 8,754,582 B2
APPLICATION NO. : 13/144505
DATED : June 17, 2014
INVENTOR(S) : Juergen Klier and Richard Pfaller It is certified that error appears in the above-identified patent and that said Letters Patent is hereby corrected as shown below:

IN THE SPECIFICATION:

Column 2, line 9, delete “at least” and write “at at least” in place thereof.

Column 2, line 15, delete “at least” and write “at at least” in place thereof.

Column 4, line 59, delete “at least” and write “at at least” in place thereof.

Column 4, line 61, delete “at least” and write “at at least” in place thereof.

Signed and Sealed this
Tenth Day of February, 2015

Michelle K. Lee

Michelle K. Lee
*Deputy Director of the United States Patent and Trademark Office*